United States Patent [19]

Pfeiffer et al.

[11] 4,261,945

[45] Apr. 14, 1981

[54] METHOD FOR PROVIDING SHAPED FIBER

[75] Inventors: Ronald E. Pfeiffer; Relmond H. Hamilton, both of Pensacola, Fla.

[73] Assignee: American Cyanamid Company, Stamford, Conn.

[21] Appl. No.: 13,346

[22] Filed: Feb. 21, 1979

[51] Int. Cl.[3] ..... D01F 6/18

[52] U.S. Cl. ..... 264/177 F; 264/206; 264/210.8

[58] Field of Search ..... 264/206, 210.8, 177 F; 425/461, 465, 467, 464, DIG. 217

[56] References Cited

U.S. PATENT DOCUMENTS

| | | | |
|---|---|---|---|
| 1,618,256 | 2/1927 | Wuthrich | 425/467 |
| 2,999,296 | 9/1961 | Breen et al. | 264/177 F |
| 3,063,094 | 11/1962 | Warthen | 264/177 F |
| 3,255,487 | 6/1966 | Nieuwenhusen | 425/467 |
| 3,574,889 | 4/1971 | Hire et al. | 425/382.2 |
| 3,608,040 | 9/1971 | Green | 264/177 F |
| 3,873,508 | 3/1975 | Turner | 260/29.6 AD |
| 3,991,153 | 11/1976 | Klausner et al. | 264/29 |

FOREIGN PATENT DOCUMENTS

| | | | |
|---|---|---|---|
| 318472 | 2/1902 | France | 425/464 |
| 45-20130 | 7/1970 | Japan | 264/177 F |
| 50-42199 | 4/1975 | Japan | 264/177 F |

*Primary Examiner*—Jay H. Woo

*Attorney, Agent, or Firm*—Frank M. Van Riet

[57] ABSTRACT

By blocking part of a spinnerette orifice with a wire strand desirable cross-sectional shaped fibers of acrylonitrile polymer are obtained.

5 Claims, 3 Drawing Figures

METHOD FOR PROVIDING SHAPED FIBER

Figure 1:
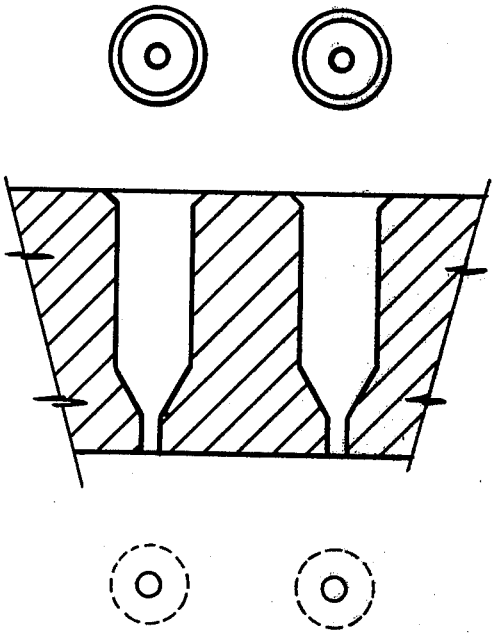

This invention relates to a process for spinning fibers of unusual cross-sectional shapes. More particularly, this invention relates to such a process wherein a strand of wire of smaller diameter than that of the spinnerette orifices is secured with the spinnerette orifices to provide unusual fiber cross-sections by blocking part of the useful spinning area of the orifices.

Recent developments in the art of spinning acrylonitrile polymer fiber have led to a fusion melt spinning procedure. In this procedure, an acrylonitrile polymer and water in proper proportions are heated to a temperature above the boiling point of water at atmospheric pressure and under sufficient pressure to maintain water in the liquid state. At appropriate temperature and pressure a homogeneous single phase fusion melt of polymer and water will form at a temperature below the deterioration temperature below which the polymer would normally melt. In preferred embodiments, this fusion melt is extruded through a spinnerette directly into a steam-pressurized solidification zone maintained under conditions which prevent sheath-core structure in the cross-section of the nascent extrudate and enable stretching to provide orientation of the polymer molecules to be accomplished while the extrudate remains within the solidification zone. This process provides a rapidly solidified extrusion composition which upon exit from the spinnerette shows no tendency towards stickiness and high conformity to the shape of the spinnerette orifices through which it is spun.

Fibers having cross-sectional shapes other than round are desirable for a number of reasons depending upon the specific nature of the shape. Fiber of ribbon shaped cross-section provide greater covering power than round fiber of the same denier and can be used in lower weight construction to provide equal cover. Fiber having various non-round cross-sectional shapes have greater surface area than the conventional round fibers of the same denier and provide advantages in applications where surface area is important. Such fibers generally have more attractive esthetic qualities such as feel, touch, handle, and wearing comfort. They also generally show increased moisture regain and reduced problems due to static electricity. They also provide better yarns constructions as well as knitted and woven constructions. As a result, such fibers are highly desirable for use in fabricating wearing apparel wherein their improved properties provides more attractive garments.

Spinnerettes useful for providing fibers of unusual cross-sectional shapes are extremely difficult to construct and require extremely expensive techniques to fabricate. Because of these restrictions very limited production of fiber of specially designed cross-sectional shape has been evidenced. The limited availability of fiber of specially shaped cross-sections has thus discouraged development of those fiber applications wherein special advantage is taken of their unusual cross-sectional shapes. What is needed, therefore, is a simple procedure for providing fibers of unusual cross-sectional shapes while avoiding the difficulties previously associated with their production. Such a provision would fulfill a long-felt need and constitute a significant advance in the art.

In accordance with the present invention, there is provided a process for preparing fiber of desirable cross-sectional shape which comprises preparing a homogeneous single phase fusion melt of a fiber-forming acrylonitrile polymer and water, extruding said fusion melt through a spinnerette directly into a steam-pressurized solidification zone maintained under conditions which prevent formation of a sheath-core structure in the resulting extrudate and enable orientation stretching to be effected, said spinnerette being modified by securing a strand of wire therein to block part of the useful spinning area thereof and provide said structure cross-sectional fiber shape, and stretching the nascent extrudate while it remains in said solidification zone to provide orientation of the polymer molecules.

The process of the present invention provides fiber of desirable cross-sectional shapes without the need for elaborate spinnerette constructions and difficult fabrication to provide the orifices but uses a conventional spinnerette suitably modified by simple securing of a suitable wire strand therein. The process employs as the fiber-forming composition a fusion melt which rapidly solidifies upon exit from the spinnerette to provide high conformity of the fiber cross-section to that of the modified orifice. Spinning is conducted under conditions which avoid sheath-core structure in the extrudate and those deficiencies such as density gradient, void structure, internal reflectance, and the like associated with such structure. The process is also conducted under conditions which provide orientation stretching in conjunction with solidification and avoids the need for a subsequent step to provide such stretch. Fiber of endless varieties of cross-sectional shape can be provided by suitable wire modification of the spinnerette orifices. It is possible to provide fiber of mixed cross-sections from the same spinnerette.

Figure 2:
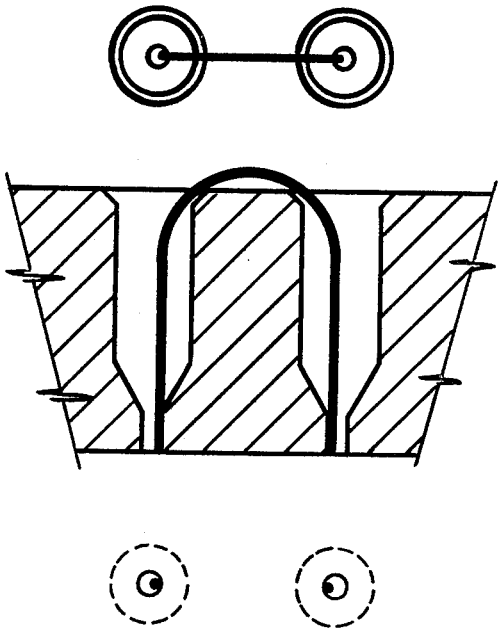
Figure 3:
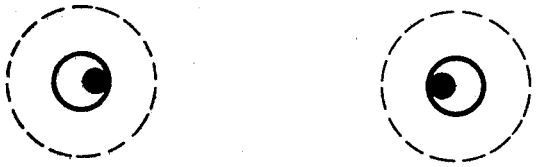

The invention is more fully described with reference to the accompanying drawings wherein FIG 1 represents a cross-sectional view of a portion of a conventional spinnerette showing two adjacent spinning orifices and the counterbores associated therewith as well as top and bottom views thereof, FIG. 2 shows the orifices of FIG. 1 modified by insertion of wire therein according to an embodiment of the present invention as well as top and bottom views thereof, and FIG. 3 shows bottom views of spinnerette orifices modified by wire inserts in accordance with the present invention.

In carrying out processing in accordance with the present invention, the only new teaching required is that of modification of the spinnerette orifice, the basic melt-spinning process being described in British Patent Specification No. 1,425,400, published Oct. 13, 1976.

To carry out the present invention, a conventional spinnerette plate is employed. The spinnerette plate will contain a plurality of orifices, each of the same size and associated with each orifice a counterbore. The spinnerette plate may have orifices of any shape that can be effectively fabricated using conventional procedures and will be of a material of construction useful in melt spinning applications. Counterbores are necessary to provide operative back pressure and should be large enough to enable the wire strand modification to obtain operative back pressure.

Wire of suitable construction material and size is provided for insertion to provide the orifice modification desired. A number of techniques for providing the wire modification of the orifices is possible. In one procedure, a single strand of suitable wire can be passed alternatively up and down through adjacent orifices until all orifices are modified and the wire ends joined to secure the wires in position. Alternatively, such technique could be used in modifying with one wire strand only the orifices in one orifice row or in modifying only two adjacent orifices. Another technique involves providing the wire in pre-cut and pre-shaped sections which then can be inserted through the counterbores to modify adjacent orifices while providing a secured fit. It is also possible to employ more than one wire to block portions of the orifices and suitable securing procedures can involve multiple wires. Additional methods of securing the wires are possible and will readily occur to those skilled in the art.

The wire used to block a part of the spinnerette orifice may be of different size and shape depending upon the nature of blocking and the resulting fiber cross-section desired. The wire, of course, should be of suitable size to fit within the orifice and leave sufficient opening for operability of the fiber spinning process. Wire of round cross-section is most common and is useful for many desirable modifications of fiber cross-section. Additional shapes of useful wire cross-sections include triangular, square, rectangular, elliptical, hexagonal, and the like as well as irregular shapes. Additional variations arise from use of orifices of cross-sectioned shapes other than round and and placing different shaped wires therein. Combinations of several different shaped wires in an appropriate shaped orifice can lead to unusual fiber cross-sections providing maximization of those desirable properties for which shaped fiber cross-sections are desired.

A preferred embodiment of the present invention is shown with respect to FIGS. 1 and 2. FIG. 1 represents a cross-sectional view of a portion of a conventional spinnerette plate showing two adjacent orifices and the counterbores associated therewith; FIG. 2 represents the same view of FIG. 1 except that the orifices have been modified with wire in accordance with the present invention. In this embodiment, a round wire was employed and inserted in a manner in which the wire touches the wall of the orifice so as to provide an open-structured fiber cross-section.

In carrying out the processing in accordance with the present invention, a homogeneous single phase fusion melt of a fiber-forming acrylonitrile and water is prepared by heating proper amounts of polymer and water in an extruder under autogeneous pressure to a suitable temperature. The resulting fusion melt is then extruded through a spinnerette assembly having a spinnerette plate modified with wire as described above. Extrusion is conducted so that the extrudate enters directly into a steam-pressurized solidification zone maintained under conditions which prevent formation of a sheath-core structure in the resulting extrudate and enable orientation stretching to be affected. The extrudate is stretched while it remains in the solidification zone to provide orientation of the polymer molecules.

In preferred embodiments, the fiber issuing from the solidification zone is dried under conditions of temperature and humidity which minimize void formation in the fiber and relaxed in steam. The fiber can be provided in desirable textile deniers with physical properties adequate for textile use.

The invention is more fully illustrated by the examples which follow wherein all parts and percentages are by weight unless otherwise specified.

EXAMPLE 1

A conventional spinnerette plate having a plurality of orifices of 200 micron diameter was modified as shown in FIG. 2 with 150 micron diameter wire resulting in free area remaining in the individual holes of about 13,740 square microns. Modification was effected by cutting short lengths of the wire, about 1 inch, and feeding the ends through adjacent orifices from the counterbore side. The wire was then pulled tight which conformed the wire to the counterbore, cut to approximate length and filed to fit flush to capillary exit.

An acrylonitrile polymer of the following composition was employed:

Onto a preformed poly(vinyl alcohol) (Evanol 71-30G) was grafted suitable components to provide a polymer composition of:

Acrylonitrile: 85%
Methyl methacrylate: 11.9%
Poly(vinyl alcohol): 3.0%
Acrylamidomethylpropane sulfonic acid: 0.1%

The polymer had a kinematic molecular weight of 42,000. Kinematic molecular weight ($\overline{M}_k$) is obtained from the relationship:

$$\mu = 1/A\ \overline{M}_k$$

wherein $\mu$ is the average effluent time in seconds for a solution of 1 gram of the polymer in 100 milliliters of 50 weight percent aqueous sodium thiocyanate solvent at 40° C. multiplied by the viscometer factor and A is the solution factor derived from a polymer of known molecular weight.

The polymer, 86 parts, and water, 14 parts, was prepared as a fusion melt in an extruder at 160° C. and autogeneous pressure and extruded through the spinnerette plate prepared as described above. Extrusion was directly into a steam pressurized solidification chamber maintained at 13 pounds per square inch gauge with saturated steam and stretching at a stretch ratio of 3.1 in a first stage and 8.3 in a second stage of stretching. The resulting fiber of about 5 denier per filament had cross-section shapes termed crescent-shaped.

We claim:

1. A process for preparing fiber of unusual cross-sectional shape which comprises preparing a homogeneous single phase fusion melt of a fiber-forming acrylonitrile polymer and water, extruding said fusion melt through a modified spinnerette directly into a steam pressurized solidification zone maintained under conditions which prevent formation of a sheath-core structure in the resulting extrudate and enable orientation stretching to be effected, said spinnerette being modified by securing a strand of wire in each of the orifices therein to block part of the useful spinning area of each orifice, and provide said unusual cross-sectional fiber shape, and stretching the nascent extrudate while it remains in said solidification zone to provide orientation of the polymer molecules.

2. The process of claim 1 wherein said stretching is at a stretch ratio of about 25.

3. The process of claim 1 wherein said fiber-forming acrylonitrile polymer is a graft of acrylonitrile and methyl methacrylate on polyvinyl alcohol.

4. The process of claim 1 wherein the stretched extrudate is dried under conditions of temperature and humidity which minimize void formation.

5. The process of claim 4 wherein the dried extrudate is relaxed in steam.

* * * * *